US005550529A

United States Patent [19]

Burge

[11] Patent Number: 5,550,529

[45] Date of Patent: Aug. 27, 1996

[54] ACCESS CONTROL SYSTEM

[75] Inventor: Gregory L. Burge, Salem, Oreg.

[73] Assignee: Supra Products, Inc., Salem, Oreg.

[21] Appl. No.: 494,881

[22] Filed: Jun. 26, 1995

[51] Int. Cl.[6] ..... G08B 13/00

[52] U.S. Cl. ..... 340/296; 340/542; 340/825.31; 70/447; 70/455; 70/460

[58] Field of Search ..... 340/296, 297, 340/542, 545, 546, 825.31, 825.34; 70/454, 455, 63, 337, 389, 447, 460

[56] References Cited

U.S. PATENT DOCUMENTS

| | | | |
|---|---|---|---|
| D. 288,899 | 3/1987 | Floyd et al. | D8/330 |
| D. 290,442 | 6/1987 | Floyd et al. | D8/330 |
| 3,343,386 | 9/1967 | Hall | 70/423 |
| 3,739,608 | 6/1973 | Young | 70/209 |
| 3,866,445 | 2/1975 | Erwin | 70/428 |
| 3,976,318 | 8/1976 | Krus | 292/346 |
| 4,070,882 | 1/1978 | Ruiz | 70/427 |
| 4,073,165 | 2/1978 | Grundstrom et al. | 70/371 |
| 4,107,967 | 8/1978 | Grabb | 70/427 |
| 4,123,924 | 11/1978 | Dworkis | 70/237 |
| 4,227,388 | 10/1980 | Nigrelli et al. | 70/427 |
| 4,418,551 | 12/1983 | Kochakis | 70/18 |
| 4,426,859 | 1/1984 | Floyd | 70/18 |
| 4,428,211 | 1/1984 | Hermann | 70/34 |
| 4,457,240 | 7/1984 | Hungerford | 109/45 |
| 4,503,692 | 3/1985 | Grint | 70/418 |
| 4,609,780 | 9/1986 | Clark | 340/825.31 |
| 4,651,544 | 3/1987 | Hungerford | 70/63 |
| 4,665,727 | 5/1987 | Uyeda | 70/279 |
| 4,686,840 | 8/1987 | McCarroll | 70/54 |
| 4,838,052 | 6/1989 | William et al. | 70/63 |
| 4,884,424 | 12/1989 | Meyer | 70/427 |
| 4,953,374 | 9/1990 | Wiebe | 70/416 |
| 4,967,576 | 11/1990 | Warfman | 70/63 |
| 5,033,280 | 7/1991 | Johnson | 70/232 |
| 5,063,766 | 11/1991 | Applebaum | 70/428 |
| 5,083,122 | 1/1992 | Clark | 340/825.32 |
| 5,119,651 | 6/1992 | Yang | 70/52 |
| 5,170,907 | 12/1992 | Sakai | 220/481 |
| 5,195,342 | 3/1993 | Werner | 70/417 |
| 5,201,202 | 4/1993 | Kam | 70/168 |
| 5,203,187 | 4/1993 | Kane | 70/455 |
| 5,245,652 | 9/1993 | Larson et al. | 70/63 |
| 5,280,518 | 1/1994 | Danler et al. | 379/100 |
| 5,372,021 | 12/1994 | Smith | 70/63 |
| 5,379,617 | 1/1995 | Zagoroff | 70/18 |
| 5,387,903 | 2/1995 | Cutter et al. | 340/825.31 |
| 5,460,020 | 10/1995 | Hungerford | 70/63 |

FOREIGN PATENT DOCUMENTS

| | | |
|---|---|---|
| 405061 | 1/1991 | European Pat. Off. . |
| WO94/12749 | 6/1994 | WIPO . |

*Primary Examiner*—John K. Peng
*Assistant Examiner*—Davetta C. Woods
*Attorney, Agent, or Firm*—Klarquist Sparkman Campbell Leigh & Whinston

[57] ABSTRACT

An electronic security enclosure conceals a device, such as a switch, valve, outlet, or lock, behind a movable member. When the movable member is unlocked, by an electronic key, and moved to reveal the concealed device, the key is captured, preventing its removal until the enclosure is again secured over the device. A variety of operational features, including provision for keyholder access restrictions, time-of-day restrictions, provision of different classes of keys for employees and vendors, etc., are also provided. The invention also contemplates a plurality of access control devices, including lock boxes, padlocks, mortise locks, cam locks, etc., that are each operable by a common electronic key.

14 Claims, 5 Drawing Sheets

ACCESS CONTROL SYSTEM

FIELD OF THE INVENTION

The present invention relates to physical security systems, and more particularly relates to controlled-access enclosures for locks, latches, switches, outlets, valves, and the like.

BACKGROUND AND SUMMARY OF THE INVENTION

For expository convenience, the present invention is described with reference to an illustrative application thereof, namely the provision of a locked cover for mechanical locks. However, it should be recognized that the invention is not so limited. Instead, it finds application wherever access to a fixture, such as an electrical or phone outlet, a hose bib, a switch, a valve or the like, should be restricted.

Companies with mechanically-keyed doors constantly face the dilemma of whether to re-key a door or facility when a "key carrying" employee quits or is terminated. A similar issue arises when an employee loses a key. While electronic access control systems provide technical solutions to these problems, cost and installation issues associated with their implementation limit their use.

PCT publication WO 94/12749 to Hungerford shows a hybrid system in which a key to a mechanical door lock is held in a battery powered strong box adjacent the door. The strong box has a keyboard on its face. If a user correctly enters a code number on the keyboard, the strong box opens and the user can use the key contained therein to open the locked door.

While advantageous in some respects, the Hungerford system is disadvantageous in others. For example, the problem of key security still persists. If a user duplicates the key while it is out of the strong box, the element of electronic protection provided by the system is essentially defeated. The mechanical lock must be re-keyed to make the system secure again.

Further, the provision of a keypad on the outside of Hungerford's strong box invites vandalism. Keyboards are also notoriously difficult to waterproof, making the internal lock electronics susceptible to water damage. Still further, there is the recurring problem of battery failure, which can render the strong box permanently locked (or freely openable, if designed to fail in that mode). Moreover, the Hungerford system does nothing to enhance the security of the keyed lock itself; the keyed lock is still accessible to attack using conventional locksmithing tools.

In a known variant of the Hungerford system, an existing mortise lock is removed from a door and replaced with a simple flip bolt latch. A security lid is then mounted over the flip bolt. A user can only gain access to the flip bolt by entering a code on a keypad on the lid. If the code is entered properly, the lid can be opened, and the user can turn the flip bolt.

While this latter system rectifies certain of Hungerford's drawbacks, it introduces others. One is the need to remove an existing mortise lock and replace it with the flip bolt. Another, relating to physical security, is the substitution of a simple flip lock for what may have been a more robust mortise lock. Other problems of the original Hungerford system persis, including vandalism, battery failure, etc.

In accordance with a preferred embodiment of the present invention, the foregoing and other drawbacks of the prior art are overcome. An electronic security enclosure conceals a keyed lock (or other mechanical access device, such as a door knob, latch, release knob, etc.) behind a movable member. When the security enclosure is unlocked by an electronic key, and the movable member is moved to reveal the keyed lock, the key is captured, preventing its removal until the enclosure is again secured over the keyed lock. A variety of operational features, including provision for keyholder access restrictions, time-of-day restrictions, provision of different classes of keys for employees and vendors, etc., are also provided.

The foregoing and additional features and advantages of the present invention will be more readily apparent from the following detailed description, which proceeds with reference to the accompanying drawings.

DETAILED DESCRIPTION

To provide an comprehensive disclosure without unduly lengthening this specification, applicant incorporates by reference U.S. Pat. Nos. 5,280,518, 5,090,222, 5,046,084, 4,967,305, 4,864,115, 4,851,652, 4,800,255, 4,777,556, 4,594,637, and copending applications Ser. Nos. 07/790,642, 07/819,345, 08/099,743, and 08/119,967, each of which is owned by the present assignee and details structures, circuitry, operational features, etc., that can be advantageously employed in a security enclosure according to the present invention.

The present invention is illustrated with reference to an illustrative application thereof, namely securing a keyed lock. It will be recognized, however, that the invention can likewise be used with a great variety of other mechanical access devices (deadbolts, mortise locks, flip locks, latches, doorknobs, padlocks, release knobs, etc.,).

Figure 1:
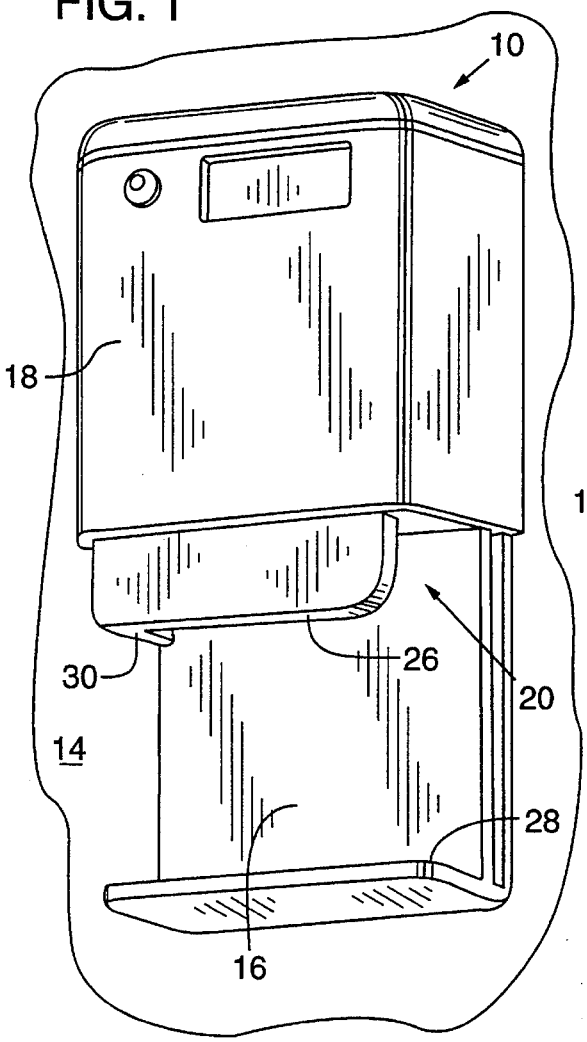
FIG. 1 is a view of a security enclosure according to one embodiment of the present invention.
Figure 2:
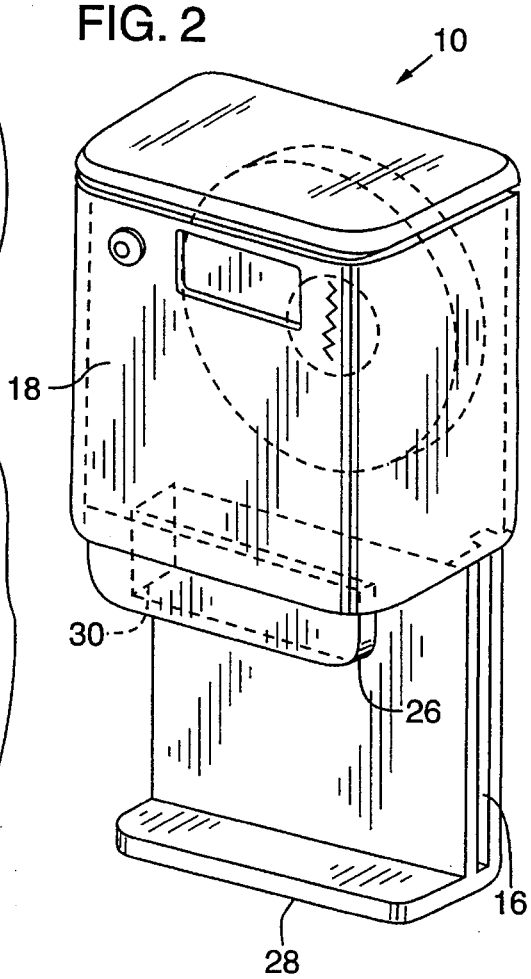
FIG. 2 is another view of the enclosure of FIG. 1 showing its placement over an existing deadbolt/mortise lock.
Figure 3:
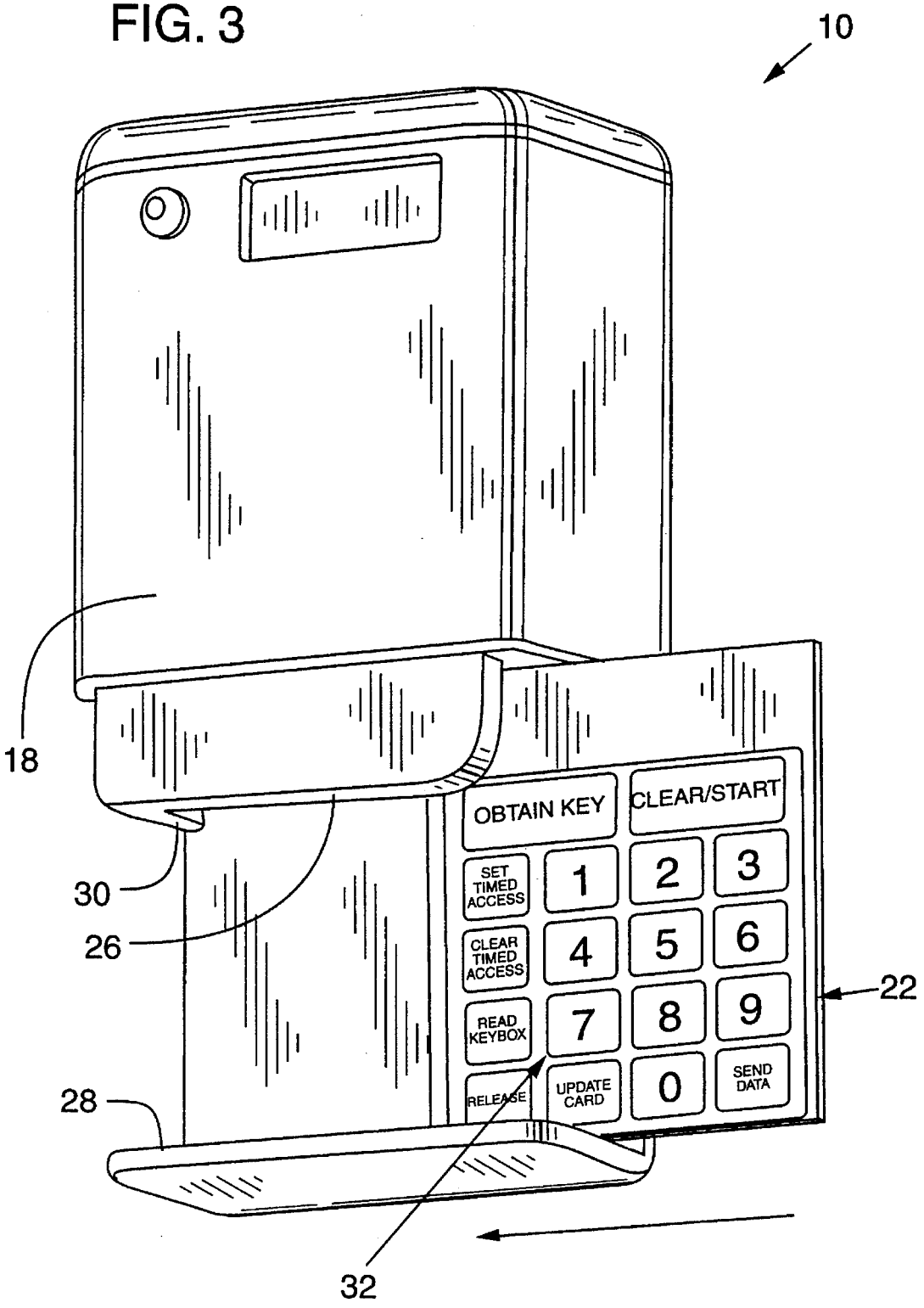
FIG. 3 shows how the security enclosure of FIG. 1 is adapted to receive an electronic key.
Figure 4:
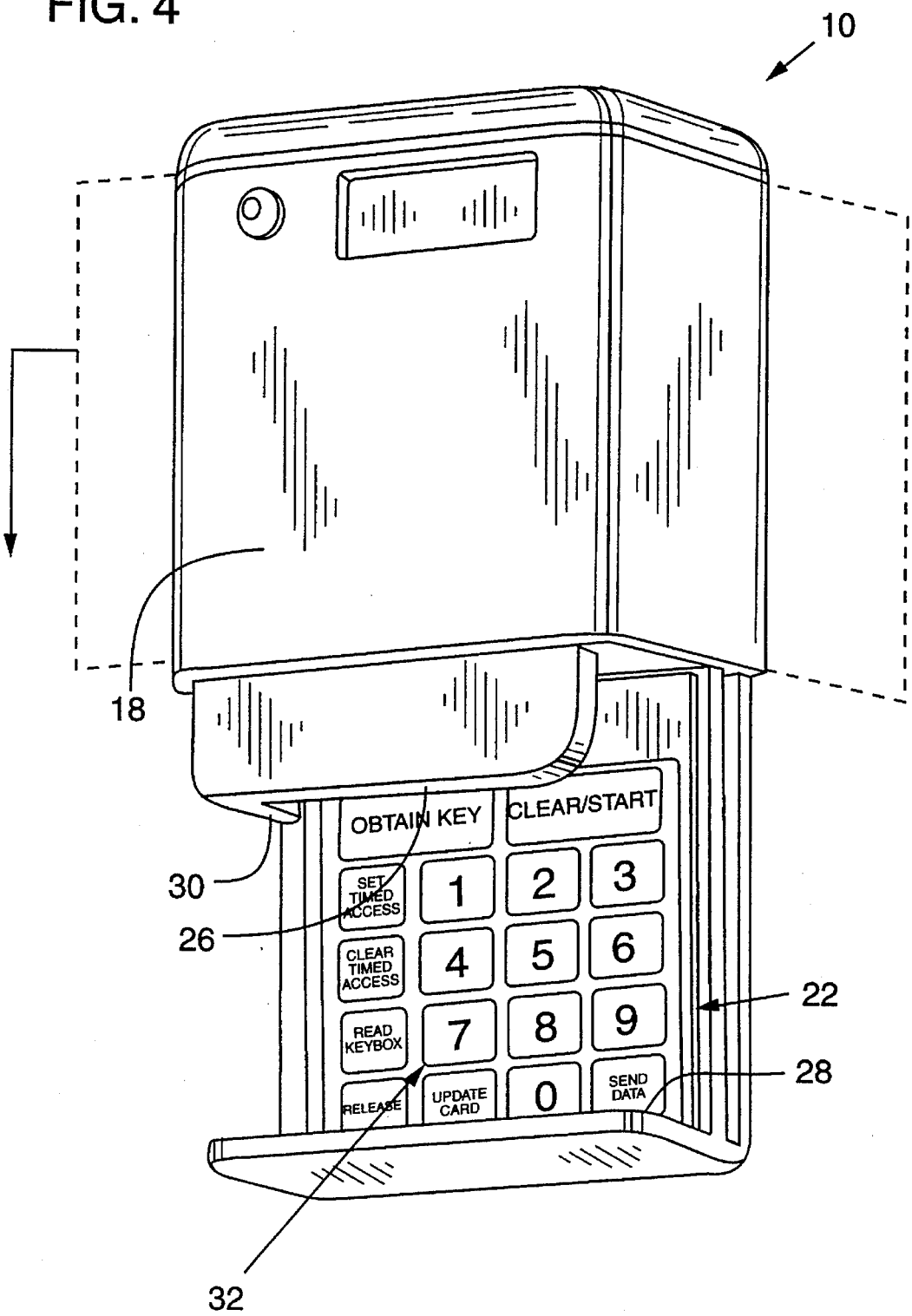
FIGS. 4–6 shows how opening of the security enclosure of FIG. 1 reveals the keyed lock concealed therein, and also acts to trap the key, preventing its removal.

Referring to FIGS. 1–6, the illustrated security enclosure 10 is formed of durable metal or high impact plastic, and is secured over a keyed door lock 12 on a door or door frame 14. The enclosure includes a base plate 16, a slidable member 18, and a nest 20 for receiving an electronic key 22 (FIG. 3).

The base plate 16 defines an opening 24 through which the keyed door lock 12 can be accessed. The edges 25 of the base plate define tracks in which the slidable member is engaged. The nest 20 is defined, in part, by a lip 26 that extends downwardly from beneath the slidable member 18 and forms a channel into which the key can be positioned.

The key 22 is a known device, and may be of the sort illustrated in the foregoing patent references. To open the security enclosure, the key 22 is slid into the nest 20, with the bottom of the key resting on a footer 28, until the key abuts a stop member 30. The keypad 32 thereon is then operated to, e.g., enter a personal identification number (PIN), and request opening of the slidable member 18 (e.g. by pressing the Obtain Key button 32*a*).

If keypad 32 is operated in the correct sequence, signals are sent to control electronics 34 (FIG. 7) in the security enclosure 10 (which can be, e.g., of the form detailed in the cited patent references). The control electronics, in turn, send an actuating signal to a solenoid-controlled latch 36, which releases the slidable member 18 from its illustrated, latched position. The user then slides the slidable member downwardly to reveal the keyed lock 12. In so doing, the user's key 22 is trapped behind the slidable member.

Once the keyed lock 12 is exposed, the user operates same with a mechanical key. In the illustrated embodiment, the user carries the mechanical key with him, but in other embodiments, the mechanical key can be disposed behind the slidable enclosure on a durable tether, thereby available to anyone authorized to open the security enclosure 10. (It will be recognized that mechanical keys to the door lock 12 can be distributed widely, since they are useless to persons without authorization to operate the electronic security enclosure.)

After the user has operated the keyed lock, the slidable member 18 must be returned to its original, latched, position before the user's key can be removed from its entrapped position in the nest 20.

In the illustrated embodiment, the control circuitry 34 and associated solenoid-controlled latch 36 do not rely on an internal battery for their operating power. Instead, they receive operating power from the key 22, by an arrangement such as is taught by the cited patent references.

The fastening of the security enclosure 10 on door 14 is accomplished by threaded fasteners which cannot be accessed without first sliding the slidable member 18 to the lower position. In some embodiments, a mounting bracket is first mounted to the door 14, and the security enclosure is then mounted thereto.

Figure 5:
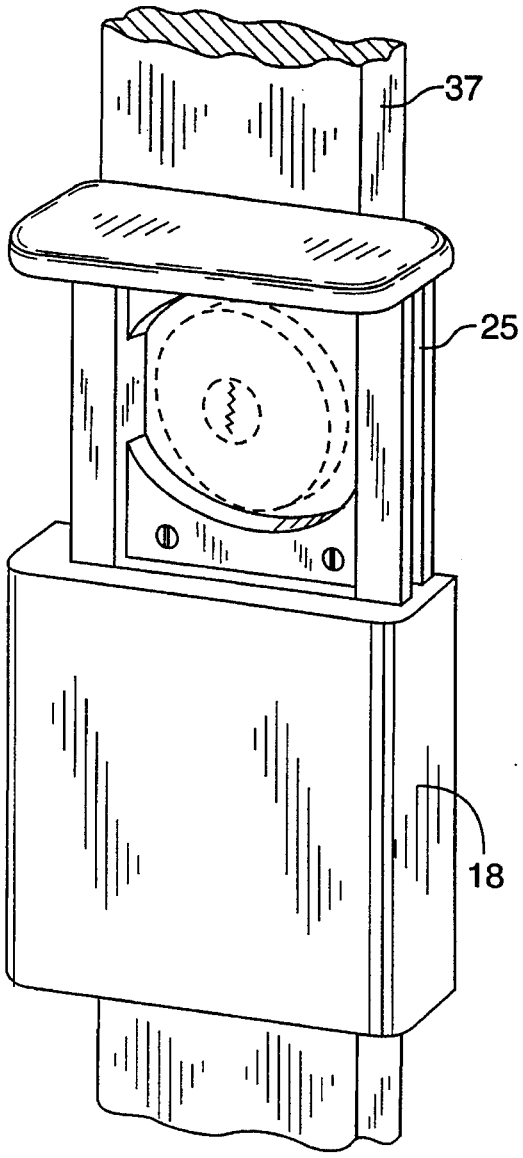
Figure 6:
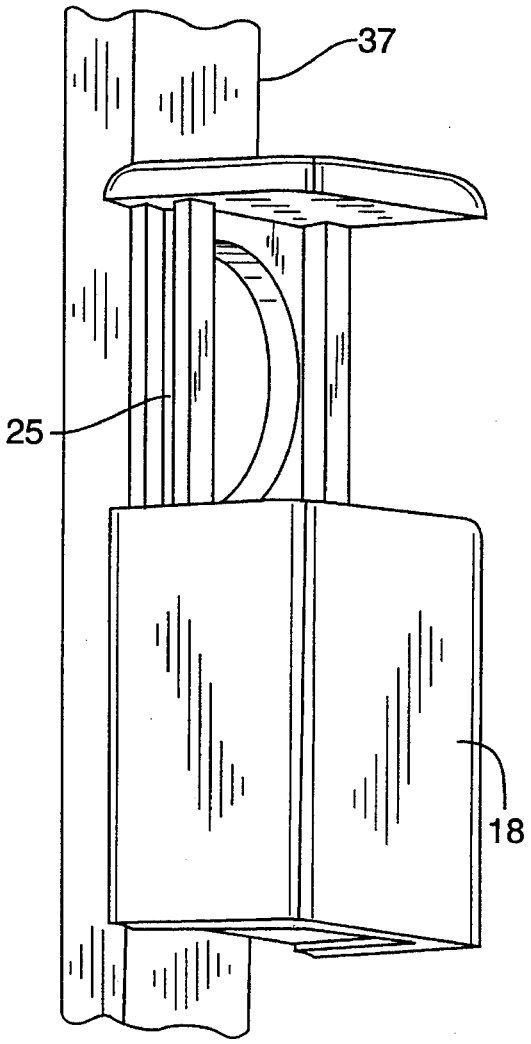

In some door installations (e.g. with glass doors), the lock may be mounted in a relatively thin frame member, such as member 37 in FIGS. 5–6. The preferred embodiment is desirably designed to mount on members as narrow as two inches across.

(If desired, a magnetic alarm contact can be provided at sites that want to trigger a master alarm if the security enclosure is removed from the door 14 in a criminal attack. The control circuitry within each security enclosure may be programmed to interface with common alarm system protocols, enabling the system to be de-activated or activated by the authorized release of the security enclosure.)

Figure 7A:
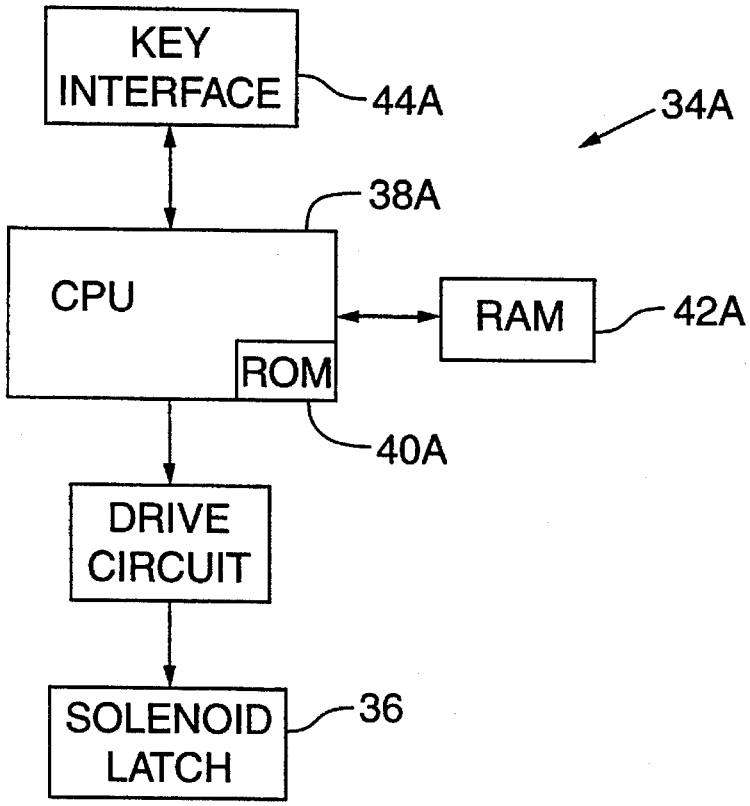
FIGS. 7A and 7B are electrical block diagrams of the security enclosure and key control circuits, respectively.
Figure 7B:
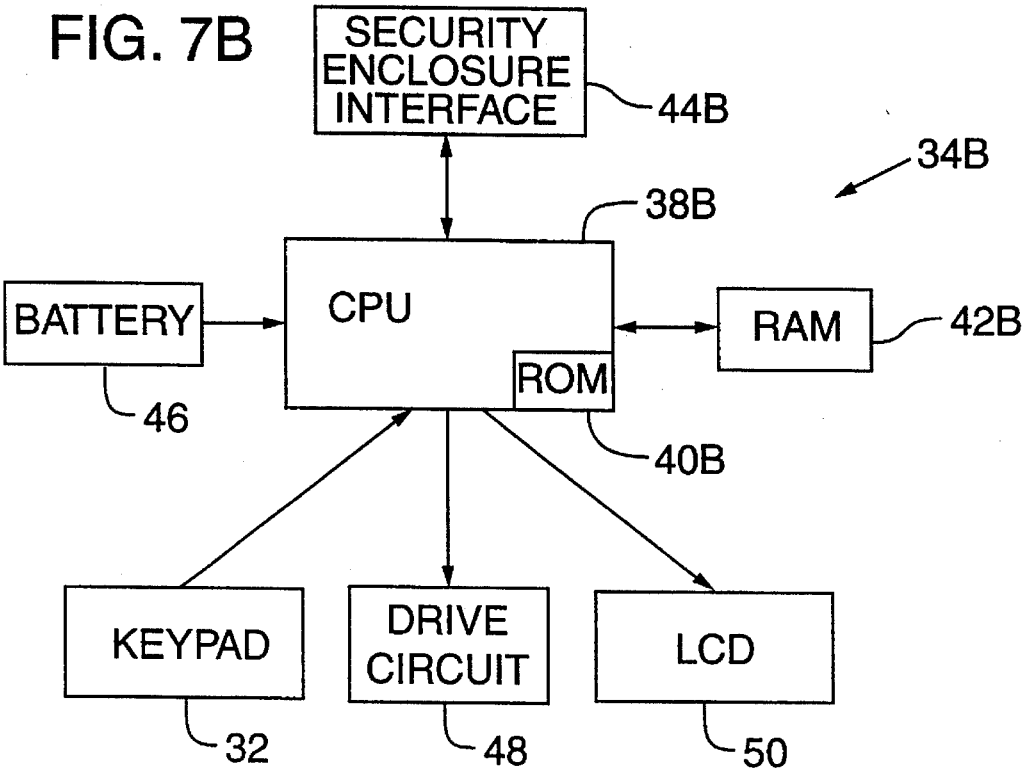

Referring to FIGS. 7A and 7B, the security enclosure and key each includes a microprocessor (CPU) 38 with associated ROM (EEPROM) memory 40 and RAM memory 42. Each further includes an interface 44 for interacting with the other. To enable powering of the security enclosure 10 from the key 22, the interface 44 desirably provides electrical connection between the key and security enclosure interfaces 44, but in other embodiments energy can be transferred by coupled coils. In embodiments where power needn't be provided to the security enclosure, other interface techniques, such as infrared, can be utilized.

The key 22 additionally includes a battery 46, a beeper 48 (which is desirably a piezo-electric transducer), an LCD display 50, a clock, and a permanently programmed ID code, all as described in the cited patent references. (The clock may be implemented using the CPU, rather than as dedicated circuitry.)

The security enclosure 10 can include a small battery if desired, e.g. to maintain the RAM memory 42*a* in a keep-alive state, or to power a light on the face of the lid. (This light can be programmed to flash during certain hours of the day, simulating an alarmed condition.) But the power to operate the solenoid latch 36 is, as noted above, derived from the key 22.

The provision of a microprocessor and memory in both the security enclosure and the key allows for a host of operational features, some of which are reviewed below, and others of which are detailed in the cited patent references.

The illustrated system contemplates use of keys belonging to a variety of different classes, each with different restrictions. (The keys themselves are identical, but are programmed to effect different capabilities.)

The most capable key is the owner/manager key. In addition to opening the security enclosure, this key is used to program the security enclosure control circuitry 34, and to read the access log information which has been recorded therein.

In the depicted embodiment, there is only one owner/manager key for each security enclosure. This correspondence is effected by assigning each security enclosure with a unique initialization code, and using this code to initialize a corresponding owner/manager key.

In particular, the process for initializing a key for a specific security enclosure is as follows. First, from the menu prompts on the display 50, the user selects the option "Initialize Security Enclosure,"followed by the user's PIN code. Next, the user selects the option "Master" from the menu prompts, and follows this with a user-selected master code. After the user enters this code, the key is slid into the nest 20. (As detailed in the cited patent references, the preferred key allows most keyboard entries to be made before the key is mated with the lock device—in this instance the security enclosure.) The control circuits in the key and security enclosures then communicate and effect initialization so the enclosure thereafter recognizes that key, alone, as its owner/manager key.

During the foregoing process, the owner/manager key creates a "scrambled" initialization code that is generated from the serial number of the key and a user-selected master code. This is the initialization code that is written into the memory of the security enclosure, together with the serial number of the owner/manager key.

If the owner/manager key is thereafter lost or stolen, each of the security enclosures that it "owned" must be re-initialized. This process requires knowledge of the scrambled initialization code. This code is obtained from the system database, where it is reconstructed by knowledge of the lost key's serial number and PIN code, and the user-selected master code. Once this initialization code is obtained, the security enclosure can be re-initialized from a new owner/manager key by the following procedure. From the key menu, the "Re-initialize" option is selected, followed by a valid PIN code. The display next prompts for the previous scrambled initialization code. After this code is entered, the key is inserted into the nest 20 and the key and security enclosure communicate to complete the reinitialization process.

The security enclosure creates a new scrambled initialization code, and writes it and the serial number of the new owner/manager key into its memory. The old owner/manager serial number is erased. This disqualifies the original owner/master key from further use.

If any of the codes necessary for reinitialization is forgotten, there is an option for a "grand master" key to be used to erase all programming in the security enclosure. After erasing this programming, the "Initialize" process is selected and a new owner/manager key is assigned to the security enclosure.

The other functions performed with the owner/manager key are programming of security enclosures, and reading their access logs. Consider the illustrative application of a security enclosure used to control access to a locked doors at a franchise restaurant. The restaurant manager would use the owner/manager key to program each security enclosure within the facility. This programming would allow authorized employee keys (another class of keys) to open the security enclosures. This is accomplished by programming the serial number of each authorized employee key into the memory of the security enclosures. This process typically takes less than 30 seconds.

To lock out an employee key, the restaurant manager simply reverses the process and removes the serial number of the employee key from the memory of the security enclosures. This feature allows the restaurant manager to instantaneously prevent an employee from gaining access to a mechanical lock.

In a like manner, the restaurant manager can effect other programming options, including restricting access by day, time of day, etc.

The step-wise procedure for these programming operations follows the general model of the initialization procedure detailed above, but the different functions are selected from the menu prompts on the display.

The other function available to owner/manager keys is to recover access log information from a security enclosure. To perform this operation, the restaurant manager inserts the owner/manager key into the nest 20 and selects the "Read" option from the menu prompts. The access log data stored in the security enclosure's memory is then written to the key memory.

From the key memory, the data can be handled in various ways. The simplest utilizes the display on the key to present abbreviated access data (e.g. date, time, serial number of accessing key) for viewing by the manager. A button on the keypad is used to scroll from one entry to the next.

More comprehensive review of the access data can be provided in one of two manners. For small installations (those without a central administrative computer), the restaurant manager telephones a service provider, such as the assignee. A synthesized voice at the service provider's facility instructs the manager to position the key transducer 48 next to the phone mouthpiece, and operate the keyboard to initiate an audible downloading of the data from the key over the telephone. (Again, this process is further detailed in the cited patent references.) The service provider's computer then provides a voiced recitation to the manager of the downloaded access data. The manager can choose, by Touch-Tone instructions, to have the service provider send the downloaded data in FAXed form to a telephone number entered by the manager during the phone call. If the service provider has not earlier been provided with data correlating key serial numbers to the keys' respective custodians, the voiced or FAXed access log data will include serial numbers rather than names.

Companies with large numbers of security enclosures may choose a second option, namely to install their own central computer and support facilities. Such a system allows enterprise-wide tracking of access data in a master database, and enables interpreted reports (e.g. names instead of numbers), and reports specialized for different security tracking applications (e.g. reports detailing accesses for each employee, reports detailing accesses to particular security enclosures, etc., etc.).

The second class of key, as alluded to earlier, is the employee key. This is the key assigned to individuals who are employees of the organization utilizing the security enclosures. For example, in the restaurant example cited above, shift managers who currently carry mechanical keys would be assigned electronic employee keys.

To open the security enclosure, the employee simply inserts the key into the next, and depresses the "Open" button. (Entry of a PIN code is optional for employee keys.) If a security enclosure has not been programmed to accept a particular employee key, the enclosure will not open.

The third class of key is the vendor key. Many organizations have been forced to issue mechanical keys to delivery companies and service companies for after hours access. This creates a number of problems, not the least of which is auditing the vendors' use of these keys. Any change in vendor status requires rekeying of the locks.

Vendor keys according to the preferred embodiment of the present invention overcome these problems. Such keys are programmed to expire (become inactive) at a preset interval (e.g. daily, weekly, etc.). Such keys also automatically compile a log detailing each security enclosure access they've made (by enclosure ID, date and time.) To reactivate an expired key, the user must obtain an update code from the central computer and input that code into their key. During the process of obtaining this code, the central computer requires the keyholder to download all of its logged activity. This audit trail allows a manager to see the daily, weekly, or monthly activity of each vendor and each vendor keyholder.

The provision of update codes to vendors is desirably automated. Each vendor, if classified in the central computer database as "active," can obtain a key update code, via Touch-Tone, 24 hours per day, 7 days per week.

The expiration feature eliminates the need for the facility manager to program each security enclosure with all of the potential serial numbers of the vendors who have been granted access to the facility. The need for the facility manager to perform a lockout function if a vendor key is stolen is also greatly diminished.

The preferred vendor key also requires a vendor access code (in addition to the user's PIN) to open a security enclosure. Each vendor is assigned a different code. Each person using a vendor key must enter the vendor access code into the key (or have the key preprogrammed with this code) in order to gain access to the enclosure. Each security enclosure must be programmed with the vendor codes that it is to accept.

This feature enables an organization, such as the cited restaurant franchise, to provide or deny access to vendors by reprogramming the security enclosures to accept or reject the vendor access code. This feature provides the end results of a change in mechanical lock, but can be accomplished within minutes and without any expense.

The vendor access code can also be used as a building access code, since it can be specific to one (or more buildings).

Each security enclosure can be programmed for a variety of access control levels. Control levels can be effected on a per-enclosure or per-key basis, or more generally.

Each security enclosure can be programmed to lock out all keyholders by date, during specific hours of the day, or it can be set at a "privacy" level which prevents all keys from opening the enclosure (except the owner/manager key). In this programming mode, all keys are subject to the programming options set in the enclosure. In the preferred embodiment, the enclosures have the capability to store 12 different lockout dates (e.g. holidays), and five daily time-of-day lockouts.

Security enclosures can also be programmed on a per-key basis. For example, an enclosure can be programmed to lock out a specific employee key on specific days, or at specific times of day (e.g. an employee can be limited to access from 8:00 a.m. to 5:00 p.m. on Mondays, Wednesdays, and Fridays, only). Each security enclosure can store such key-specific programming instructions for up to 100 different keys.

Each security enclosure can also be programmed with up to 20 different vendor access codes, and have different day of week, and time of day restrictions for each.

If desired, embodiments according to the present invention can advantageously employ radio-reprogramming and radio-preauthorization, as detailed in the cited patent references.

From the foregoing, it will be recognized that the illustrated embodiment of the present invention finally solves the longstanding problem of mechanical re-keying, and does so without the cost or difficulty of replacing existing locks with electronic counterparts. Further, the illustrated embodiment can be installed without any wiring, and does not suffer from the battery failure problems of prior "solutions."

In accordance with another aspect of the present invention, a family of different access control devices is provided, each of which is operable with a common key. One such access control device can be a security enclosure of the sort described above. Another can be a strong box mounted to a building and having a key contained therein. Yet another can be an electronic padlock having a lockable shackle operable with the electronic key. Still another is a mortise door lock having a locking bolt that extends linearly to engage with a recess in a cooperating member (e.g. door frame). Yet another is a cam lock having a locking member that rotates into a locking position to prevent a secured member from moving. Each of these access control devices receives power from the key, and serves to log access data as set forth above.

Having described the principles of my invention with reference to a preferred embodiment and certain variations thereon, it should be apparent that these examples can be modified in arrangement and detail without departing from such principles. For example, while the illustrated embodiment contemplates providing each security enclosure with a list of keys to be accepted, in other systems the enclosure can be provided with a list of keys to be "locked out," and accept all other keys of a given class (e.g. assigned to a given corporate employer). Likewise, the illustrated embodiment can employ various combinations of other features disclosed in the cited patent references. Still further, while the invention has been illustrated with reference to a protective member 18 which slides to reveal the keyed lock within the enclosure, a variety of other mechanical access arrangements, such as hinged doors, can alternatively be employed. Likewise, other mechanical aspects of the illustrated embodiment can be varied in ways familiar to the artisan. Yet further, the principles of the present invention can also be applied to systems like those discussed in the Background section in which an existing mechanical lock is replaced with a simple flip lock, and the security enclosure is used to restrict access thereto.

As noted earlier, the applicability of the invention extends beyond securing locks, and encompasses securing any fixture (generally flush mounted). For example, in settings such as public marinas and campgrounds, there may be power and water hook-ups that are to be used only by paying customers, and are thus candidates for use of the present invention. Likewise, telephone outlets may be provided in generally public places (such as in meeting rooms in hotels), and access thereto should be restricted. Still other applications include switches of various forms and purposes (e.g. for controlling power to life support equipment in hospitals). Yet other applications include valves and connections to various fluid and gas supplies.

In view of the many possible embodiments to which the principles of the invention may be put, it should be recognized that the detailed embodiments are illustrative only and should not be taken as limiting the scope of my invention. Rather, I claim as my invention all such embodiments as may come within the scope and spirit of the following claims and equivalents thereto.

I claim:

1. A security enclosure adapted to restrict access to a device positioned on a surface, said device being in the group consisting of locks, switches, valves, and outlets, the enclosure comprising:

a first member for mounting to the surface while allowing access to the device positioned thereon;

a cover member coupled to the first member and having first and second positions, in the first position said cover member serving to prevent access to the device, in the second position said cover member allowing access to the device;

the enclosure further including a lock responsive to a key, the lock serving to latch the cover member in the first position until unlocked by the key;

said cover member serving to prevent removal of the key when the cover member is in its second position, wherein a user must return the cover member to its first position in order to retrieve the user's key.

2. The security enclosure of claim 1 in which operating power for the security cover is derived from a battery in the key.

3. The security enclosure of claim 1 in which the key includes a keypad thereon.

4. The security enclosure of claim 1 in which the cover member is slidably movable between the first and second positions.

5. The security enclosure of claim 1 in which the cover member is pivotably movable between the first and second positions.

6. A method of controlling access to a device, the device being a member of the group consisting of locks, switches, valves, and outlets, the method comprising:

providing a security enclosure restricting access to the device, the enclosure having a first position in which access to the device is prevented and a second position in which access to the device is enabled;

providing a key for accessing the security enclosure by changing the enclosure from the first to second positions; and trapping the key when the security enclosure is in the second position, and releasing the key only when the security enclosure is returned to the first position.

7. The method of claim 6 in which the device is an electrical power outlet.

8. The method of claim 6 in which the device is a telephone outlet.

9. The method of claim 6 in which the device is a hose bib.

10. The method of claim 6 in which the device is a gas outlet.

11. The method of claim 6 in which the device is a fluid outlet.

12. The method of claim 6 in which the device is a valve.

13. The method of claim 6 in which the device is a switch.

14. The method of claim 6 which includes logging data in a security enclosure memory, said data identifying keys that have been used therewith.

* * * * *